US008376698B2

(12) United States Patent
Vedsted

(10) Patent No.: US 8,376,698 B2
(45) Date of Patent: Feb. 19, 2013

(54) PUMP UNIT

(75) Inventor: Per Frost Vedsted, Bjerringbro (DK)

(73) Assignee: Grundfos Management a/s, Bjerringbro (DK)

( * ) Notice: Subject to any disclaimer, the term of this patent is extended or adjusted under 35 U.S.C. 154(b) by 866 days.

(21) Appl. No.: 12/500,253

(22) Filed: Jul. 9, 2009

(65) Prior Publication Data

US 2010/0008771 A1 Jan. 14, 2010

(30) Foreign Application Priority Data

Jul. 10, 2008 (EP) ..... 08012461

(51) Int. Cl.
*F04D 29/44* (2006.01)

(52) U.S. Cl. ..... 415/199.2

(58) Field of Classification Search ..... 415/199.1, 415/199.2, 199.5, 200, 211.2, 214.1, 215.1, 415/901
See application file for complete search history.

(56) References Cited

U.S. PATENT DOCUMENTS

| | | | | |
|---|---|---|---|---|
| 3,438,329 | A * | 4/1969 | Fuller | 415/199.3 |
| 3,477,384 | A * | 11/1969 | Hlinka | 415/199.3 |
| 6,979,174 | B2 * | 12/2005 | Watson et al. | 415/200 |
| 7,278,822 | B2 * | 10/2007 | Stanzel | 415/199.5 |
| 2007/0224040 | A1 * | 9/2007 | Kawabata et al. | 415/199.2 |

FOREIGN PATENT DOCUMENTS

EP 0588258 A1 3/1994

OTHER PUBLICATIONS

Office Action Issued Feb. 24, 2011 in Chinese Application Ser. No. 200910140183.6.

* cited by examiner

*Primary Examiner* — Ninh H Nguyen
*Assistant Examiner* — Joshua R Beebe
(74) *Attorney, Agent, or Firm* — Panitch Schwarze Belisario & Nadel LLP

(57) ABSTRACT

A pump assembly has a housing formed of at least two metallic housing parts (2) and at least one diffuser (12) arranged in the housing, wherein the diffuser (12) is fixed between the two housing parts in the axial direction, and the two housing parts (2) are directly or indirectly in metallic contact with one another, in a manner such that a force transmission in the axial direction between the housing parts (2) is effected via elements of metal.

8 Claims, 5 Drawing Sheets

PUMP UNIT

BACKGROUND OF THE INVENTION

The invention relates to a pump assembly with a housing formed of at least two metallic housing parts, and with at least one diffuser arranged in the housing. Such designs are particularly known with multi-stage pumps, whose housing is formed of several housing parts, which are in each case assigned to a pump stage. Each pump stage comprises a diffuser, which leads the flow exiting from the impeller to a subsequent impeller. These diffusers must be fixed in the inside of the housing. For this, in the case that the diffusers are designed of metal, it is known to weld these in the housing. Moreover, it is known to provide diffusers of plastic with radially projecting projections or with an annular radial projection, which are clamped between the adjacent housing parts. For this, in the state of the art, enlarged bearing surfaces which come into contact with the projections of the diffuser, are provided at the axial ends of the housing parts.

The design of the bearing surfaces on the housing parts however demands an increased manufacturing expense on manufacture of the housing parts.

BRIEF SUMMARY OF THE INVENTION

With regard to this, it is the object of the invention to provide a pump assembly which permits a simpler design of the housing parts.

This object is achieved by a pump assembly with the features specified in claim 1. Preferred embodiments are to be deduced from the dependent claims, the subsequent description as well as the attached figures.

The pump assembly according to the invention comprises a housing formed of at least two metallic housing parts. Thereby, it may be the case of the outer housing, as is the case for example with submersible pump assemblies. It may thereby however also be the case of an inner housing, which is surrounded at a distance once again by an outer housing, in order to form a flow path in the axial direction between the inner and the outer housing. Such a design is often selected with multi-stage pump assemblies set up in a dry manner. The pump assembly according to the invention is designed in a preferably multi-stage manner, wherein each housing part forms the housing of one stage. This design is known and permits different numbers of stages to be combined with one another in a modular manner, in order to be able to form pump assemblies with different powers. Each stage of the pump assembly comprises a diffuser, which is arranged after the impeller in the flow direction, and leads the flow exiting the impeller to a subsequent impeller or to the exit of the pump. For this, the diffusers are provided with suitably shaped flow channels or however preferably blades similar to the impellers.

With the pump assembly according to the invention, a diffuser is fixed in each case between two metallic housing parts, in particular clamped. An axial fixation of the diffuser in the housing may be achieved in a very simple manner by way of this, without additional assembly steps or fastening means being required for the fixation of the diffuser in the housing.

In order now to be able to design the bearing surfaces on the housing parts in a smaller manner, or to be able to completely make do without these bearing surfaces on the axial ends of the housing parts, according to the invention, it is suggested to connect the two housing parts to one another with a metallic contact in a direct or indirect manner. Thus the force flux of the pressure force in the axial direction, which is transmitted from one housing part onto the adjacent, other housing part, may be effected essentially only via elements of metal. Large bearing surfaces which are necessary when plastic parts are situated in the force flux, may be done away with by way of this design. The metallic elements may accommodate significantly higher pressure/compressive forces than plastic parts, so that here one may allow greater surface pressings, so that the same forces may be transmitted via smaller bearing surfaces. Thus in the ideal case, the housing parts are designed as tube sections, which have a continuous constant inner diameter and outer diameter without broadened bearing surfaces at the axial end. It is thus possible to manufacture these sections in an inexpensive manner without great manufacturing expense either by way of bending sheet metal with a subsequent welding, or by way of cutting a tube/pipe to length. Despite this, a simple fixation of the diffuser between the two housing parts is retained.

According to a first preferred embodiment, the two housing parts are in direct contact with one another with their axial ends. This means that the housing parts are directly in metallic contact with one another, and the axial force flux between the housing parts is effected directly via the bearing surface, at which both housing parts are in direct contact with one another. Thus the compression forces, which act on clamping the housing parts, are kept away from the diffuser fixed between the housing parts. The clamping is effected in the known manner preferably by way of tightening straps or tightening bolts which are applied outside the housing and extend in the axial direction.

In order to be able to fix the diffuser between the housing parts despite the direct metallic contact of the housing parts, preferably a recess is formed in at least one of the housing parts at an axial end facing the other housing part, into which recess the diffuser engages with a corresponding, radially projecting projection. In this manner, one may create a positive-fit connection between the diffuser and the housing in the axial direction, without the diffuser being situated in the force flux between the housing parts. The recess in the housing part is preferably open to the end-side, so that the projection of the diffuser is fixed in the axial direction between the base of the recess and the end-edge of the adjacent housing part. Thereby, the height of the projection in the axial direction may be selected such that a certain clamping of the projection is effected, but such that the force flux between the housing parts is effected essentially not via the projection but essentially via a direct bearing of the housing parts on one another. Alternatively, recesses may be formed also in both housing parts at the axial end, into which a projection of the diffuser engages. Thereby, the housing parts are preferably arranged such that the recesses which are open to the end-side of the respective housing part, face one another and together define a larger recess, which corresponds to the axial height of the projection. The projection may be held preferably without play in both recesses in this manner.

However, other designs of a recess in one of the housing parts and of a corresponding projection on the diffuser are likewise possible. In particular, the recess does not need to extend over the whole wall thickness of the housing part in the radial direction. Thus e.g. according to an alternative embodiment, at least one of the housing parts at an axial end facing the other housing part, may be designed in a conical or stepped manner on the inner periphery, and the diffuser may comprise at least one corresponding radial projection, which engages into the region of the housing part which is designed in a conical or stepped manner, wherein the housing parts on the outer periphery are preferably in direct contact with one another. A recess in the housing part or between the housing parts which are adjacent to one another, and which faces the inner periphery of the housing and does not extend outwards through the housing wall in the radial direction, is created in this manner by way of the conical or stepped design. Thus on the outside, a gapless bearing of the housing parts on one another may be created, and the diffuser simultaneously fixed in the inside between the housing parts with a positive fit. The force flux between the housing parts which arises by way of clamping the housing parts, is thereby effected in the region of the outer periphery, where the housing parts are in direct contact with one another. Preferably both housing parts which are adjacent to one another, are designed in a correspondingly conical or stepped manner. If two conically designed housing parts are placed on one another, a peripheral groove triangular in cross section is created on the inner periphery at the connection region, into which groove the diffuser may engage with a corresponding projection which is trapezoidal or triangular in cross section. The direct contact between the adjacent housing parts is thereby effected at the axial end, i.e. in the region in which the housing parts have their largest inner diameter. If two housing parts designed in a stepped manner are applied onto one another, a peripheral groove rectangular in cross section is created on the inner periphery at the connection region, into which groove the diffuser may engage with a corresponding projection which is rectangular or, as the case may be, also trapezoidal in cross section. The direct contact between the adjacent housing parts is thereby also effected at the axial end.

Individual projections may be formed in the diffuser as projections, which are preferably distributed uniformly over the periphery of the diffuser. According to a preferred embodiment, the projection may also be designed as a radially projecting ring. Such a projection would then extend essentially over the complete outer periphery of the diffuser. Thereby, the ring may be designed in a closed manner, but also in an open manner, i.e. may not extend over the whole periphery. Thus e.g. a gap or recess may be formed in the ring, via which gap or recess a certain angular position of the diffuser in the housing may be defined.

According to a further embodiment of the invention, the diffuser may comprise at least one metallic element, which is clamped between the axial ends of the housing parts. This design thus permits the force flux not having to be effected directly from one housing part onto the next housing part, but indirectly via the metallic element lying therebetween. However, the housing parts remain in metallic contact with one another, i.e. of two housing parts which are adjacent one another, the first housing part bears on one side of the metallic element, whilst the second housing part bears on the opposite side of the metallic element. Thus the force flux may be effected in the axial direction via the metallic elements which may accommodate larger compressive forces than a plastic, from which the remaining diffuser is preferably manufactured. Preferably, the complete force flux in the axial direction which arises on clamping the housing parts, is effected via one or more metallic elements. Thereby however, it is also conceivable for the housing parts to additionally be in direct contact with one another. For this, a projection of the diffuser for example, which engages into a recess of one or both housing parts, may comprise a metallic element or be formed completely of a metallic element.

The diffuser is preferably manufactured of plastic and the at least one metallic element is cast into the plastic. In this manner, one may create a firm connection between the metallic element and plastic. The metallic element or elements are applied into the injection moulding tool before the casting of the diffuser, so that the plastic may then flow around and enclose the metallic elements in a defined manner. Recesses, projections or undercuts may be formed on the metallic elements for an improved connection, which permit a meshing between the metallic element and plastic. The at least one metallic element projects radially outwards, preferably from the outer periphery of the diffuser, or is arranged in a radially outwardly projecting projection of the diffuser. Thus the metallic element may either be situated only in a projection of the diffuser, said projection otherwise being formed of plastic, so that it has a radial extension which corresponds essentially to the wall thickness of the adjacent housing parts. Alternatively, it is also possible for the metallic element to extend radially further inwards into the region of the diffuser, which is situated in the inner cross section of the housing parts which are adjacent to one another. In this region, the metallic element is then preferably connected to the plastic of the diffuser in a firm manner. Thus a complete projection projecting radially from the diffuser may be formed of metal.

Particularly preferably, the metallic element is designed as a metal ring, which projects radially outwards from the outer periphery of the diffuser. Thereby, the metal ring extends so far outwards in the radial direction, that it may come to lie between the housing parts which are adjacent one another. The metal ring extends inwards preferably radially beyond the inner periphery of the housing parts, so that there it may engage into the plastic of the diffuser, i.e. be cast into the diffuser. On the one hand, one may provide a maximum bearing surface for the adjacent housing parts and on the other hand one may achieve a smooth contour on the outer side of the housing, in a very simple manner, due to such a metal ring which is preferably designed in a closed manner and extends over the complete periphery of the diffuser. Preferably, the outer diameter of the metal ring corresponds to the outer diameter of the adjacent housing parts, so that a smooth gapless outer contour of the pump housing may be created when the individual elements are applied onto one another. This embodiment permits a very simple manufacture of the individual housing parts, since these may be designed in a completely tubular manner with smooth end-edges or end-sides. The end-sides, as the case may be, need merely to be turned or ground in a plane manner, and despite this no recesses or grooves are to be machined.

According to a further embodiment of the invention, the diffuser may be manufactured at least partly of metal and comprise a radially projecting projection, which is clamped between the axial ends of the housing parts. This design too then permits a force transmission in the axial direction only via metallic elements. In particular, it is preferable to design the diffuser as a cast part, for example as a metal powder injection moulded part. Complex shapes may be designed with metal powder injection moulding in a very simple manner. Thus, a radial outwardly projecting projection or several radially outwardly projecting projections may be formed on the diffuser in a simple manner, for the axial fixation of the diffuser. These, since they are designed of metal, may transmit the occurring compressive forces without any problem. However, such metallic projections do not necessarily have to lie in the force flux, but as described above, may also engage into recesses or for example a peripheral groove, which results from the conical shape of the axial end of the housing part. Particularly preferably, the complete diffuser is thus manufactured completely of metal. This may be a single-part design, but it is also possible for the diffuser to be composed of several parts, wherein the parts are then preferably welded to one another.

Advantageously, the housing parts are formed in each case of a cylindrical non-elbowed tube section. Non-elbowed in the context of the invention is to be understood in that the tube section at its ends is not deformed by bending inwards or outwards or deformed in any other manner, for increasing its surface area. It is to be understood that this does not include deformations as may arise e.g. with the mechanical cutting to length of a tube section, or compression deformations, which are caused in a targeted manner. Thereby, the tube section does not necessarily need to have a geometrically cylindrical shape, but, as the case may be, may also be curved inwards or outwards in the middle region. Such a cylindrical non-elbowed tube section may be manufactured in a particularly inexpensive and simple manner. It may either be formed of a cylindrical tube by way of cutting to length, or, as is particularly advantageous, may be formed of flat strip, which cut to length, is shaped into a cylinder section and is connected at the lateral surface by way of welding to a tube section. A cylinder tube section which is formed in this manner is then calibrated, in order to achieve the necessary roundness and finally machined at the end sides, typically at the end-face sides, for example by way of grinding or also by way of turning, in order to achieve the planar parallelity of the end-sides to one another. Housing parts manufactured in such a manner may be manufactured in a simple manner without any great expense with regard to machining.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

DETAILED DESCRIPTION OF THE INVENTION

Figure 1:
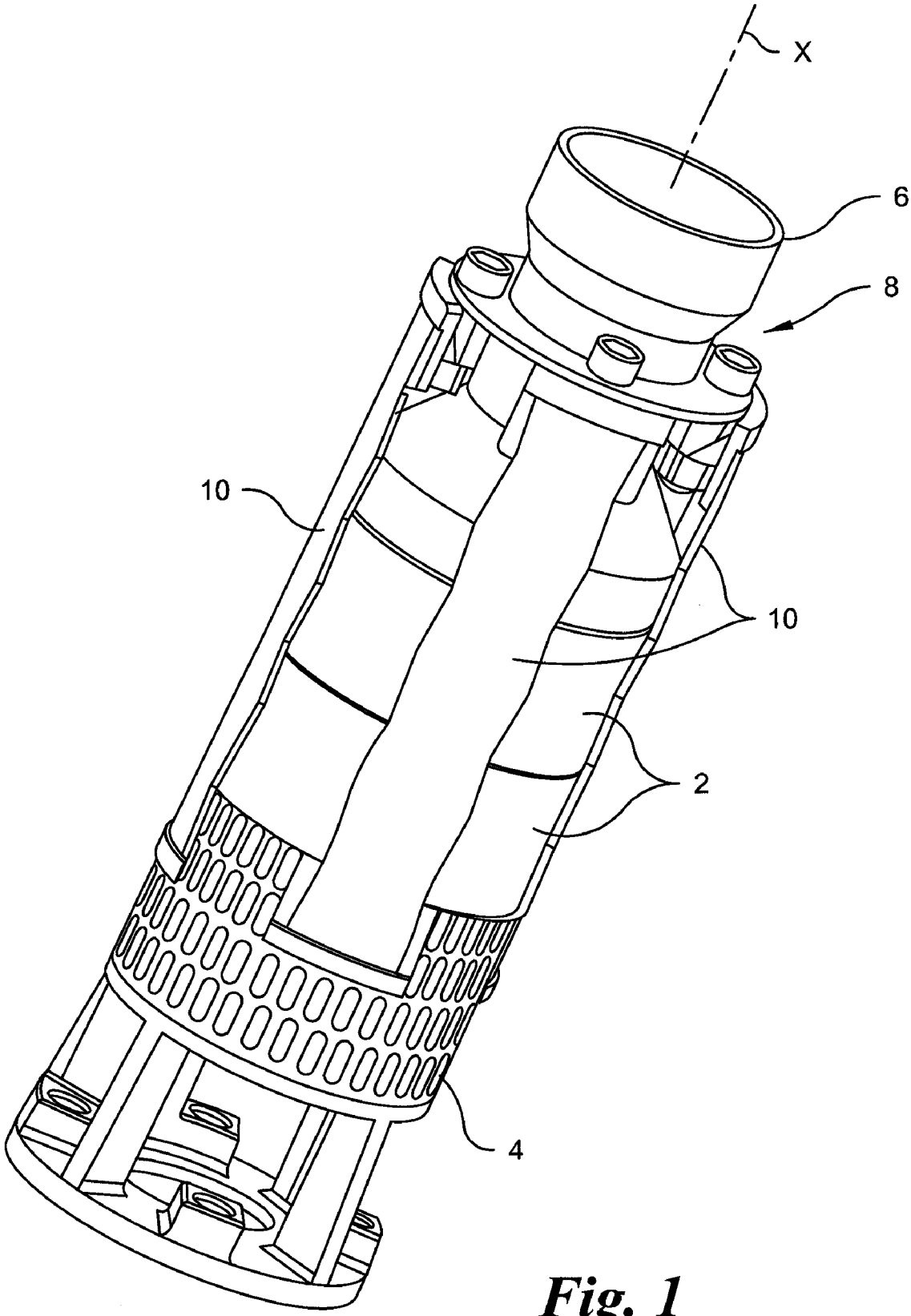
FIG. 1 is a perspective view of a pump assembly according to the invention.

FIG. 1 schematically shows the construction of a pump assembly according to the invention. The pump assembly comprises two stages, which are surrounded to the outside in each case by a housing part 2. The housing parts 2 are applied onto one another in the axial direction X. A connection piece 4 which serves for the connection of the pump stages to a drive motor, which is not shown here, connects to the housing part 2 which is at the bottom in FIG. 1. The connection piece 4 moreover comprises entry openings, through which the fluid to be delivered enters the pump or the pump assembly. The fluid is then conveyed through the pump stages into the housing parts 2 and exits out of the exit union 6 on the pump head 8.

The pump head 8 is connected to the connection piece 4 via tightening straps 10. Thereby the tightening straps 10 tighten the pump head 8 and the connection piece 4 to one another, so that the housing parts 2 are clamped between the connection piece 4 and the pump head 8 and are held bearing on one another. In the shown example, two housing parts 2 corresponding to two pump stages are shown. It is to be understood that for designing a pump with more than two pump stages, accordingly more housing parts 2 may be rowed onto one another, wherein then correspondingly longer tightening straps 10 are to be provided.

Figure 2:
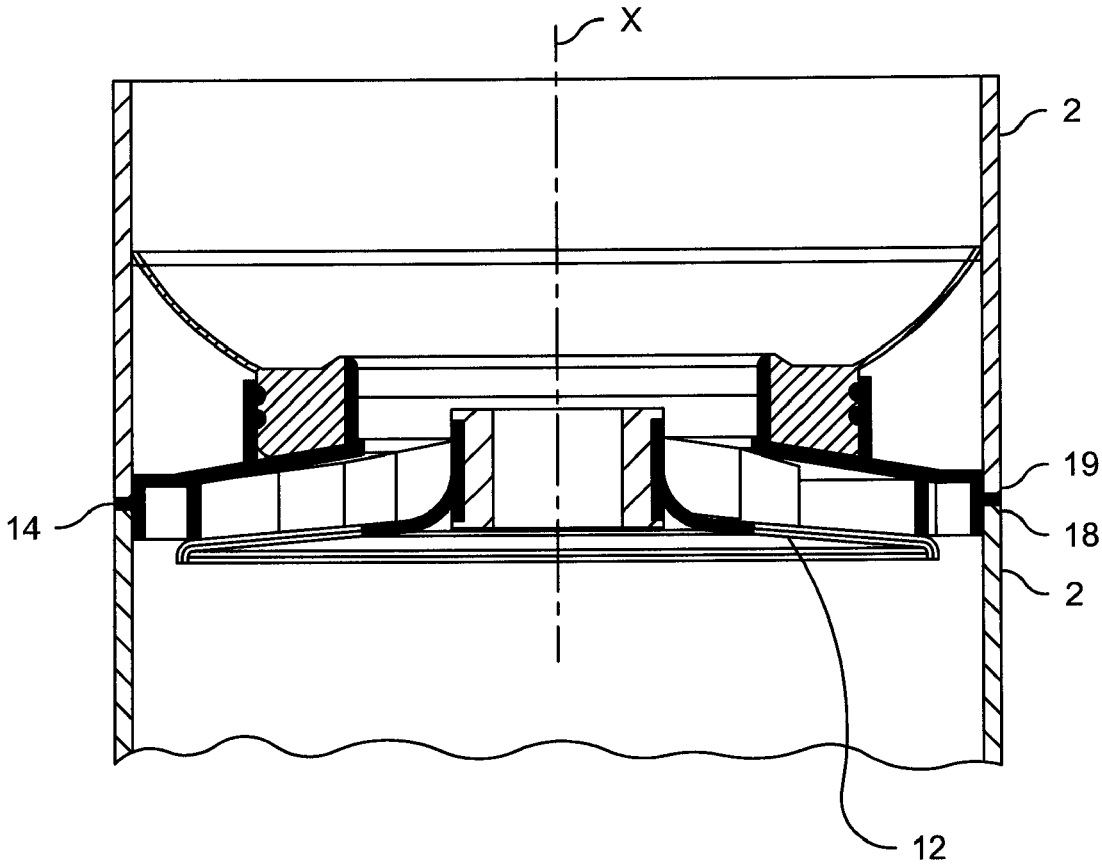
FIG. 2 is a sectioned view of the interface between two housing parts of the pump assembly according to FIG. 1.

The individual pump stages each comprise an impeller, which is connected to a drive shaft, wherein the impellers and the drive shaft are not shown here. Moreover, each pump stage comprises a diffuser 12, which is arranged in the inside of the housing formed by the housing parts 2, as shown in FIG. 2. The diffuser 2 is fixed in the inside of the housing parts 2. In the radial direction, it is fixed by way of the outer diameter of the diffuser 12 corresponding essentially to the inner diameter of the housing parts 2. In the axial direction X, the diffuser 12 is fixed in the region of the bearing or interface, between two housing parts 2 which are adjacent one another. In the embodiment according to FIG. 2, the diffuser 12 for this has a radially outwardly projecting, annular projection 14 on the outer periphery, and this projection has a radial width which corresponds to the wall thickness of the housing parts 2. The housing parts 2 are designed in a plane manner at the two end-sides which are opposite one another, so that the annular projection 14 may come to lie between the end-sides of two housing parts 2, which are adjacent one another. By way of this, the diffuser 12 is fixed between the housing parts 2 in the axial direction X. In the embodiment according to FIG. 2, the diffuser 12 is manufactured with the annular projection 14 as one piece of metal, for example as a metal powder injection moulding component.

Such a metal projection 14 is in the position of transmitting high compressive forces as are exerted by the tightening straps 10, from the one housing part 2 onto the other housing part 2 without deformation. It is thus not necessary to form specially enlarged bearing surfaces for the diffuser at the axial ends of the housing parts 2. Rather, the cross-sectional surface of the wall of the housing parts 2 is sufficient as a bearing surface, since a metallic projection 14 may accommodate larger pressure loads without any problem. This means that here a force flux from the one housing part 2 onto the other housing part 2 is achieved via the metal projection 14. Since the housing parts 2 are likewise designed of metal, preferably of stainless steel, the force transmission or the force flow is thus effected only via the contact of metallic components.

The projection 14 which is preferably likewise designed of rust-free stainless steel, in the shown example, connects to the outer periphery flush with the outer periphery of the housing parts 2, so that a smooth, gapless outer surface of the pump assembly is created. Since their axial end-sides do not need to be formed in any special manner, the housing parts 2 may be bent in a tubular manner from sheet metal, or may be cut to length into the desired length from a tube, in a very simple manner. Subsequently, at most, the end-sides need to be machined in a plane manner, so that they form a bearing surface normal to the longitudinal axis X.

Figure 3:
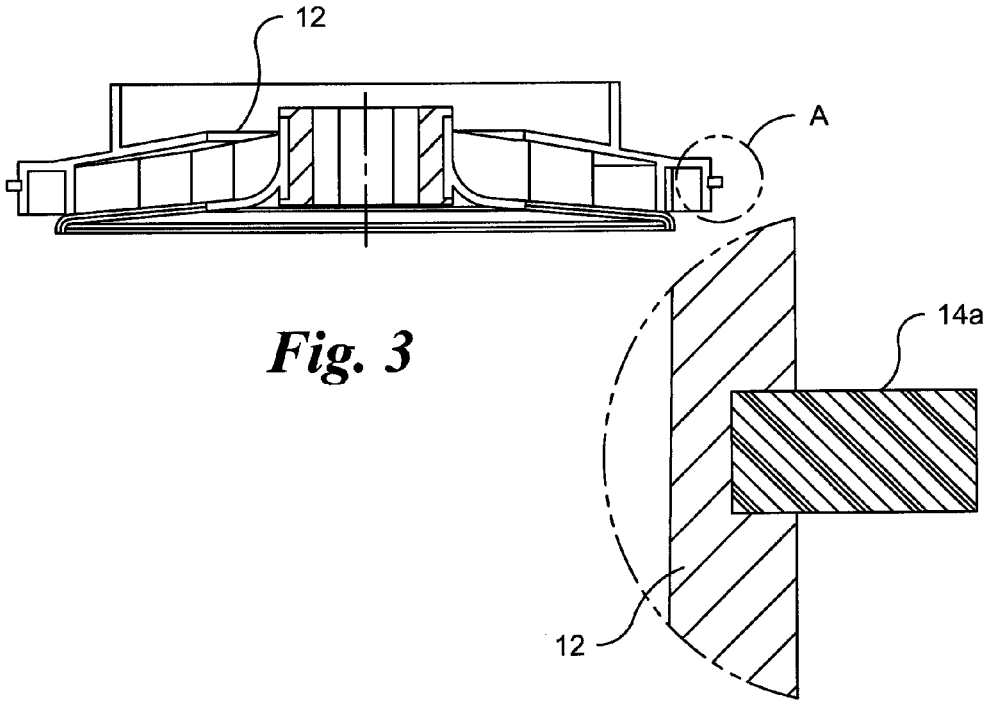
FIG. 3 is a sectioned view of a diffuser with a detail enlargement A.
Figure 4:
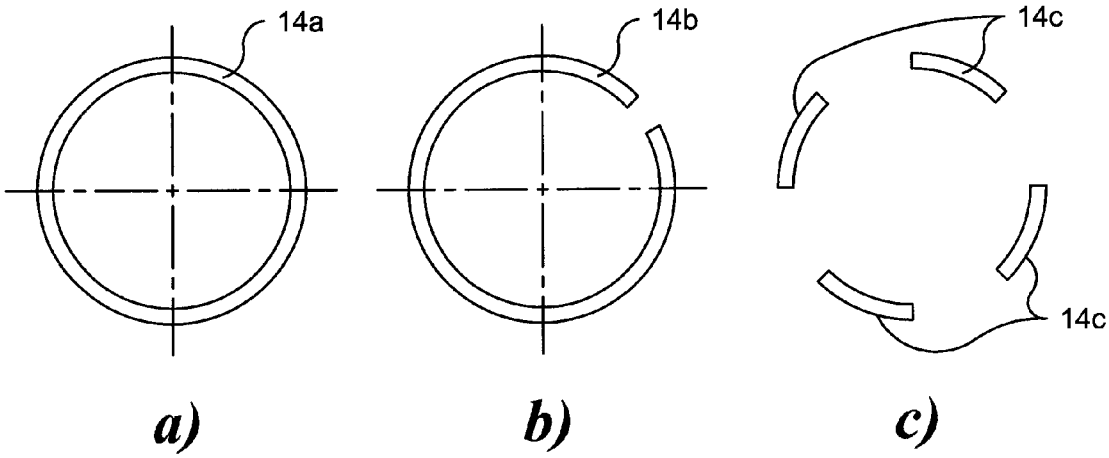
FIG. 4*a*-4*c* are schematically, differently designed projections.

For the case that the diffuser 12 is to be formed of plastic, it is possible to design the projection 14 as an insert part of metal as is shown in FIG. 3. Here, the projection 14 is designed as a metal ring 14*a*, preferably of rust-free stainless steel, as is schematically shown in FIG. 4*a*. This metal ring 14*a* is cast into the plastic of the diffuser 12. For this, the metal ring 14*a* extends in the radial direction inwards over the inner periphery of the housing parts 2, i.e. it has a smaller inner diameter than the housing parts 2. Thus the metal ring 14*a* extends radially from the outer periphery of the diffuser 12 into the inside of the material of the diffuser 12, and is held there. For manufacturing, a metal ring 14*a* for example may be inserted into the injection moulding tool, before the plastic is injected for forming the diffuser 12. Thus the metal ring 14*a* is cast in a direct manner. The metal ring 14*a* comes to lie between the housing parts 2 as well as the projection 14, as was discussed by way of FIG. 2.

FIGS. 4*b* and 4*c* show alternative designs for the projection 14. A design of a projection 14*b* in the form of an open ring is shown in FIG. 4*b*, whilst an arrangement of four circular-arc-shaped projections 14 distributed uniformly over the periphery is shown in FIG. 4*c*. Thereby, it is to be understood that the projection 14*d* as well as the projections 14*c* may be designed of metal as one piece with the diffuser 12, as discussed by way of FIG. 2. Alternatively, they may be manufactured as separate insert parts of metal and, as shown in detail A in FIG. 3, may be embedded into the material of the diffuser 12, preferably plastic, by way of casting in. In the case of casting-in, the gaps between the projections 14*c* or the gap in the projection 14*b* may furthermore be filled out with plastic material. In any case, with the design of the projections according to FIG. 4*b* and 4*c*, a force transmission between the housing parts 2 is achieved, as has been described by way of FIG. 2. The projections 14*b* and 14*c* accordingly come to lie between the end-sides of two housing parts 2 which are adjacent to one another. Thus it is also ensured with this embodiment, that the force from the one housing part 2 onto the other housing part 2 is effected essentially only via metallic elements. This means essentially no plastic components of the diffuser 12 lie in the force flux.

Figure 5:
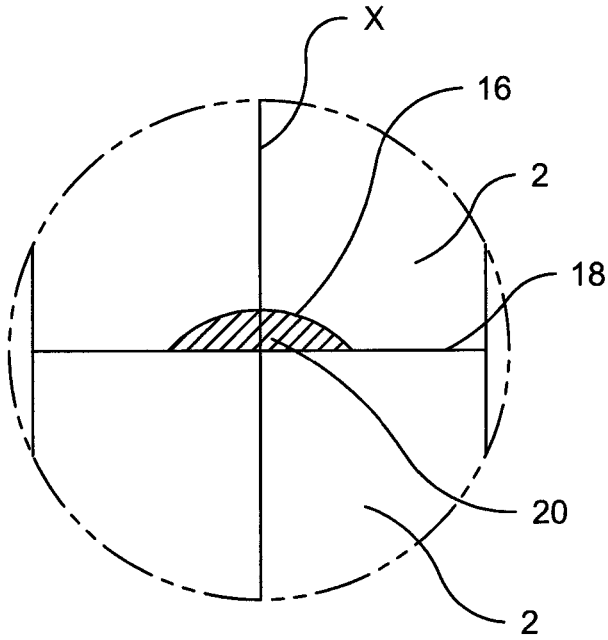
FIG. 5 is a schematic view of the interface between two housing parts, according to a further embodiment.

FIG. 5 shows a further possibility of fixing the diffuser 12 between the two housing parts 2. For this, circular-segment-shaped recesses 16 are formed in the one of the housing parts 2, and these segments are open towards the end-side 18. A projection 20 which is firmly connected to the diffuser 12, engages into the recess 16. For this, the projection 20, as previously described, may be manufactured as one piece with the diffuser, or however may be cast as a metal element into the plastic of the diffuser 12 as the projections 14*a*, 14*b* and 14*c*. With the arrangement according to FIG. 5, the force transmission from the two housing parts 2 onto one another is effected via the direct metal bearing on the end-side 18. The projection 20 in the recess 16 remains largely free of forces, so that this projection 20 may also be formed of plastic as one piece with a diffuser 12. The projection 20 has a cross section, which corresponds essentially to the inner cross section of the recess 16. It may be slightly larger, so that it is held without play between the recess 16 and the oppositely lying end-side 18 of the adjacent housing part 2. Thereby, the projection 20 however is slightly compressed when the housing parts 2 come to bear on the end-side 18. However, the deformation of the housing part 2 is limited by way of the fact that the housing parts 2 come into direct contact with one another at the end-sides 18.

Figure 6:
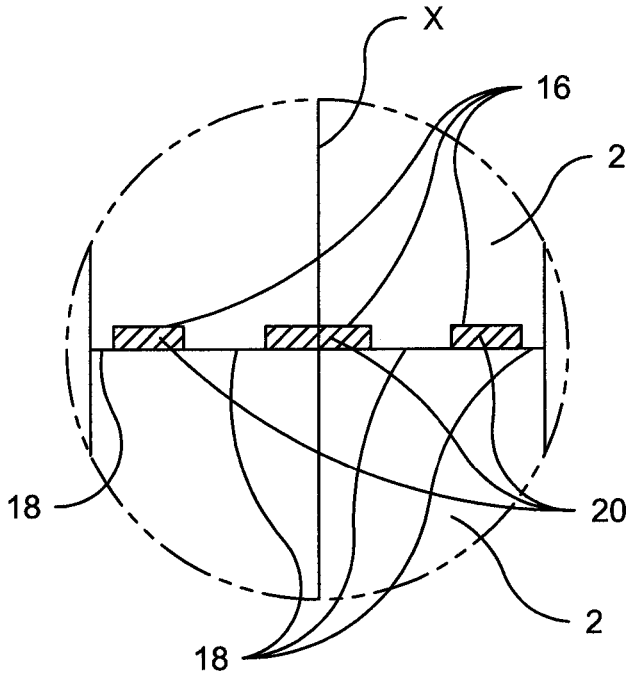
FIG. 6 is a schematic view of the interface between two housing parts, according to a further embodiment.

FIG. 6 shows a further embodiment, which corresponds essentially to the embodiment described by way of FIG. 5. There however, the recesses 16 are not designed in a circular-segment-shaped manner, but a rectangular manner. The projections 20 are shaped accordingly. The recesses 16 according to FIG. 5 as well as those according to FIG. 6 may be machined into the end-side of the housing parts 2 in a simple manner by way of milling, cutting or punching or other suitable machining methods.

Figure 7:
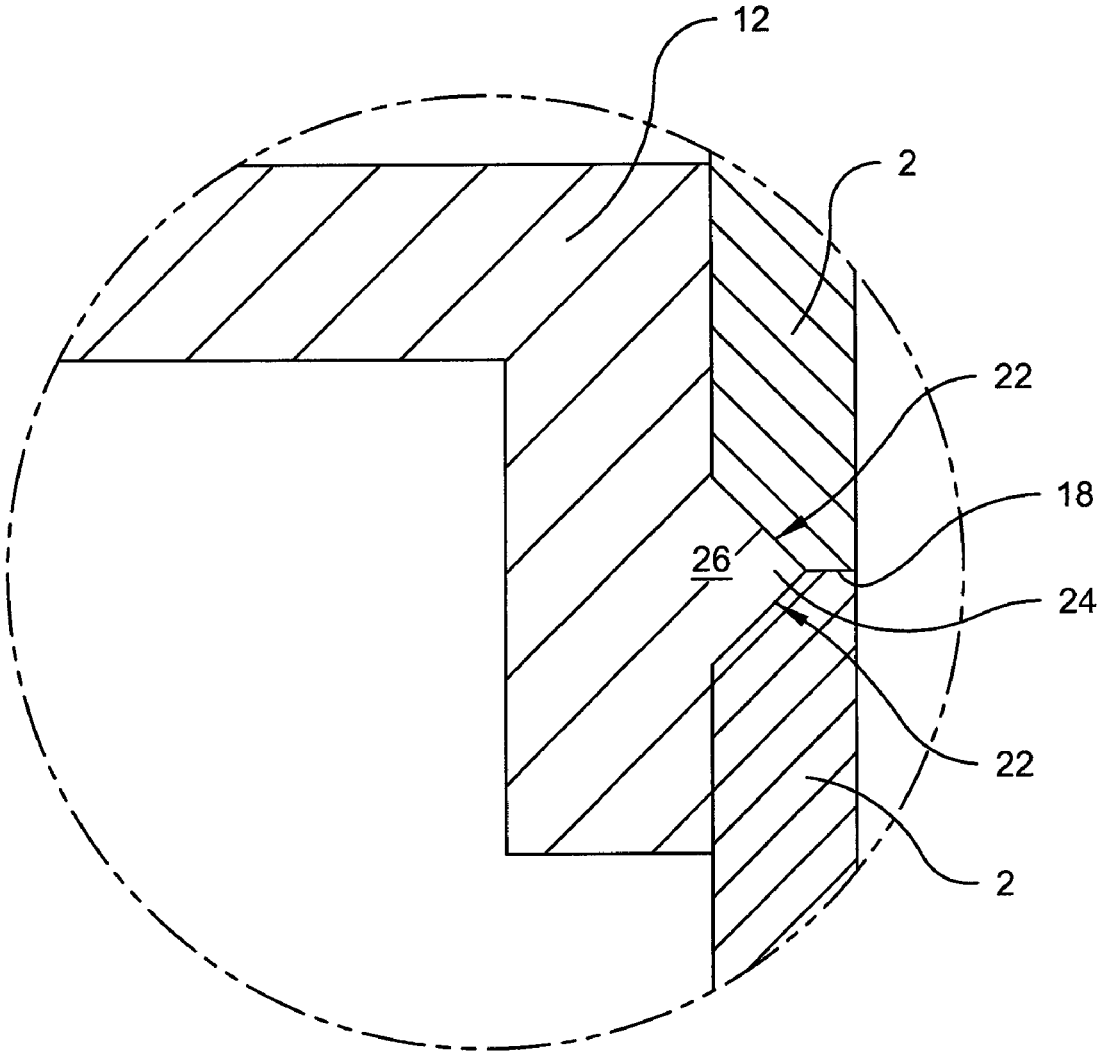
FIG. 7 is a sectioned detail view of the interface between two housing parts, according to a further embodiment.

FIG. 7 shows a further possibility of fixing the diffuser 12 in the housing parts 2 in the axial direction. For this, the housing parts 2 are provided in each case with a chamfer 22 in the region of their axial ends, i.e. adjacent to the end-face 18. The chamfers 22 are designed on the inner periphery of the housing parts 2, so that the inner diameter of the housing parts 2 widens to the axial end. If two such housing parts 2 are applied oppositely onto one another, as shown in FIG. 7, a groove 24 which is triangular in cross section is formed on the inner periphery of the housing parts 2 in this manner, which extends peripherally on the inner wall of the housing, formed from the housing parts 2. Thereby, the middle plane of the groove lies in the plane of the end-sides 18 of the housing parts 2. The diffuser 12 has a projection 26 in the form of an annular projection, formed as one piece with the diffuser 12. The projection 26 projects radially outwards from the outer periphery of the diffuser 12, and has a triangular cross section corresponding to the groove 24. In this case, the projection 26 is also designed as one piece with the diffuser 12, in particular of plastic. The projection 26 serves merely for fixing the diffuser 12 in the housing parts 2 in the axial direction. It does not need to transmit pressure forces from the one housing part 2 onto the other housing part 2. This is achieved by way of the chamfers 22 not extending up to the outer periphery of the housing parts 2, so that a piece of plane end-surface 19 adjacent to the outer periphery of the housing parts 2 remains. The housing parts 2 come into direct contact with one another at these end-faces 18, so that the force transmission is effected directly from the metal housing part 2 via the end-face 18, and the projection 26 thus does not lie in the force flux.

It is to be understood that also the projection 26 does not necessarily need to extend over the whole periphery, but that instead, several individual projections may be formed distributed over the periphery, or for example also a projection in the form of an open ring similarly to FIG. 4*b*.

Common to all described embodiments is the fact that the force transmission between two housing parts 2 which are adjacent one another is effected essentially via only metallic elements. This may be a direct contact of the metallic housing parts 2 or an indirect contact with an intermediate lying metal element. In any case, plastic parts of the diffuser 12 are held essentially free of pressure/compressive forces. Thus the abutment surfaces may be designed in a very small manner and the metallic elements may accommodate the occurring surface pressings without deformation.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A pump assembly with a housing formed of at least two metallic housing parts (2) and at least one diffuser (12) arranged in the housing, wherein the diffuser (12) is fixed between the two housing parts (2) in the axial direction (X), wherein the two housing parts (2) are directly or indirectly in metallic contact with one another in a manner such that a force transmission in the axial direction between the housing parts (2) is effected via elements of metal, wherein the diffuser (12) is manufactured of plastic and comprises at least one metallic element (14), the at least one metallic element (14) being cast into the plastic of the diffuser (12), and wherein at least a portion of the at least one metallic element (14) is positioned axially between and separates axial ends (18) of the two housing parts (2).

2. A pump assembly according to claim 1, wherein the two housing parts (2) with their axial ends (18) are in direct contact with one another.

3. A pump assembly according to claim 2, wherein at least one recess (16) is formed in at least one of the housing parts (2) on one of the axial ends (18) facing the other housing part (2), into which recess the diffuser (12) engages with a corresponding, radially projecting projection (20).

4. A pump assembly according to claim 2, wherein at least one of the housing parts (2) at its axial end facing the other housing part (2), is designed conically or stepped on the inner periphery, and the diffuser (12) comprises at least one radial projection (26), which engages into the region of the housing part formed in a conical or stepped manner, wherein the housing parts (2) are preferably in direct contact with one another on the outer periphery.

5. A pump assembly according to claim 3, wherein the projection of the diffuser (12) is designed as a radially projecting ring.

6. A pump assembly according to claim 1, wherein the at least one metallic element (14) projects radially outwards from the outer periphery of the diffuser (12) or is arranged in a radially outwardly projecting projection of the diffuser (12).

7. A pump assembly according to claim 1, wherein the metallic element is designed as a metal ring which projects radially outwards from the outer periphery of the diffuser.

8. A pump assembly according to claim 1, wherein the housing parts (2) in each case consist of a cylindrical, non-elbowed tube section.

* * * * *